US010471728B2

(12) United States Patent
Inada et al.

(10) Patent No.: US 10,471,728 B2
(45) Date of Patent: Nov. 12, 2019

(54) LIQUID EJECTION HEAD, LIQUID EJECTION APPARATUS, AND METHOD OF ATTACHING LIQUID EJECTION HEAD

(71) Applicant: CANON KABUSHIKI KAISHA, Tokyo (JP)

(72) Inventors: Genji Inada, Koshigaya (JP); Toshiaki Hirosawa, Hiratsuka (JP); Hiromasa Amma, Kawasaki (JP); Shogo Kawamura, Kawasaki (JP); Yasuhiko Osaki, Kamakura (JP); Shin Ishimatsu, Yokohama (JP); Takuya Iwano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/995,477

(22) Filed: Jun. 1, 2018

(65) Prior Publication Data

US 2018/0361748 A1 Dec. 20, 2018

(30) Foreign Application Priority Data

Jun. 15, 2017 (JP) ..... 2017-117978

(51) Int. Cl.
*B41J 2/155* (2006.01)
*B41J 2/175* (2006.01)
(Continued)

(52) U.S. Cl.
CPC ..... *B41J 2/1753* (2013.01); *B41J 2/155* (2013.01); *B41J 2/17526* (2013.01);
(Continued)

(58) Field of Classification Search
CPC .... B41J 2/155; B41J 2/17523; B41J 2/17526; B41J 2/17553; B41J 2/18; B41J 25/34;
(Continued)

(56) References Cited

U.S. PATENT DOCUMENTS 6,084,611 A 7/2000 Yamane et al.
6,371,604 B1 4/2002 Yamane et al.
(Continued)

FOREIGN PATENT DOCUMENTS

JP 2001-287352 A 10/2001
JP 2007-237446 A 9/2007
(Continued)

OTHER PUBLICATIONS

Extended European Search Report dated Nov. 21, 2018, in European Patent Application No. 18176714.6.
(Continued)

*Primary Examiner* — Lamson D Nguyen
(74) *Attorney, Agent, or Firm* — Venable LLP

(57) ABSTRACT

A page-wide liquid ejection head configured to be removably installed in a main body of a liquid ejection apparatus includes a connection part for liquid through which a liquid is supplied from the main body and an electrical connector through which an electric signal is supplied from the main body. In the liquid ejection head, the connection part for liquid and the electrical connector are located at one side of the liquid ejection head in the longitudinal direction and are provided to face different directions from each other.

14 Claims, 8 Drawing Sheets

(51) Int. Cl.
*B41J 2/18* (2006.01)
*B41J 25/34* (2006.01)

(52) U.S. Cl.
CPC ..... *B41J 2/17553* (2013.01); *B41J 2/18* (2013.01); *B41J 25/34* (2013.01); *B41J 2202/12* (2013.01); *B41J 2202/14* (2013.01); *B41J 2202/19* (2013.01); *B41J 2202/20* (2013.01); *B41J 2202/21* (2013.01)

(58) Field of Classification Search
CPC . B41J 2202/12; B41J 2202/14; B41J 2202/19
See application file for complete search history.

(56) References Cited

U.S. PATENT DOCUMENTS

| | | | |
|---|---|---|---|
| 6,416,155 | B1 | 7/2002 | Takahashi et al. |
| 6,464,338 | B1 | 10/2002 | Morita et al. |
| 6,471,901 | B1 | 10/2002 | Kawamura et al. |
| 6,592,215 | B2 | 7/2003 | Udagawa et al. |
| 6,910,759 | B2 | 6/2005 | Kawamura et al. |
| 7,690,767 | B2 | 4/2010 | Hirosawa et al. |
| 7,775,638 | B2 | 8/2010 | Hirosawa et al. |
| 9,610,792 | B2 | 4/2017 | Yoshikawa et al. |
| 2005/0157057 | A1 | 7/2005 | Silverbrook et al. |
| 2005/0243127 | A1 | 11/2005 | Higginson et al. |
| 2009/0225130 | A1 | 9/2009 | Saito |
| 2009/0295867 | A1 | 12/2009 | Oguchi |
| 2011/0279548 | A1 | 11/2011 | Yamamoto et al. |
| 2014/0292858 | A1 | 10/2014 | Wanibe et al. |
| 2016/0279936 | A1 | 9/2016 | Yamamoto et al. |

FOREIGN PATENT DOCUMENTS

| | | | |
|---|---|---|---|
| JP | 2009-279940 | A | 12/2009 |
| JP | 2014-131878 | A | 7/2014 |
| JP | 2016-175281 | A | 10/2016 |
| JP | 2016-175282 | A | 10/2016 |
| WO | 2017011923 | A1 | 1/2017 |

OTHER PUBLICATIONS

U.S. Appl. No. 16/006,297, Shin Ishimatsu, Toshiaki Hirosawa, Genji Inada, Hiromasa Amma, Shogo Kawamura, Yasuhiko Osaki, Takuya Iwano, filed Jun. 12, 2018.

LIQUID EJECTION HEAD, LIQUID EJECTION APPARATUS, AND METHOD OF ATTACHING LIQUID EJECTION HEAD

BACKGROUND OF THE INVENTION

Field of the Invention

The present invention relates to a liquid ejection head, a liquid ejection apparatus, and a method of attaching a liquid ejection head.

Description of the Related Art

Liquid ejection apparatuses that eject a liquid for image recording or the like include an apparatus including a long-length liquid ejection head having a dimension corresponding to the width of a liquid ejection object (for example, a recording medium) (page-wide liquid ejection apparatus). The liquid ejection head of the page-wide liquid ejection apparatus ejects a liquid to the full width of an object while not moved but fixed. The liquid ejection apparatus has such characteristics as to enable simultaneous ejection of a large amount of a liquid and high-speed recording by liquid ejection, for example, as compared with a serial scan apparatus having a compact liquid ejection head that ejects a liquid while moving in the width direction of an object.

The page-wide liquid ejection apparatus includes an apparatus in which a long-length liquid ejection head is exchangeable. In such a liquid ejection apparatus, liquid pathways for receiving liquids and electrical pathways for receiving electric power and electric signals for liquid ejection are formed when a liquid ejection head is installed in a casing of the apparatus main body. Hence, the exchangeable liquid ejection head includes a connection part for liquid that is connected to a main body connection part for liquid of an apparatus main body to form liquid pathways and includes an electrical connector that is connected to a main body electrical connector to form electrical pathways. The page-wide liquid ejection head is longer than the serial scan liquid ejection head and thus has, in the longitudinal direction of the head, a comparatively large space that can accommodate a connection part for liquid and an electrical connector. However, if these connection parts are spaced apart from each other, one connection part may be at a correct position, but the other connection part may be displaced from a correct position, due to inclination of the attachment posture of the liquid ejection head, for example. As a result of such a positional displacement, it may be difficult to satisfactorily, simultaneously connect both the connection parts. On this account, for the long-length liquid ejection head, both the connection parts are required to be located adjacently, or at least one connection part is required to have a flexible connection mechanism.

For example, Japanese Patent Application Laid-Open No. 2009-279940 discloses a structure in which a connection part for liquid and an electrical connector are adjacently arranged on one side end of a long-length liquid ejection head in the longitudinal direction (the width direction of a liquid ejection object). Japanese Patent Application Laid-Open No. 2016-175282 discloses a structure in which a connection part for liquid is provided around the center of a long-length liquid ejection head in the longitudinal direction and a flexible cable is provided as an electrical connector.

To the connection part for liquid of a typical liquid ejection apparatus, a pressure joining member such as a sealing rubber is provided to prevent air mixing. At such a pressure joining member provided on a connection part for liquid, a liquid is likely to adhere and stay, and the liquid staying at the pressure joining member may be scattered outside the connection part for liquid when the connection part for liquid is connected or disconnected. If the scattered liquid adheres to an electrical connector, electrical short-circuit may be caused or the electric reliability may be affected. In particular, when a connection part for liquid and an electrical connector are arranged on the same face as in the structure disclosed in Japanese Patent Application Laid-Open No. 2009-279940, a liquid scattered outside the connection part for liquid (for example, around a liquid joint included in the connection part for liquid) is highly likely to adhere to the electrical connector.

Meanwhile, in such a structure using a flexible cable for electrical connection as in Japanese Patent Application Laid-Open No. 2016-175282, a scattered liquid is unlikely to adhere to the electrical connector. However, the electrical connection using a flexible cable requires meticulous operations and is required to be performed completely separately from connection of a connection part for liquid or from install and removal of a liquid ejection head. This complicates the operation to reduce the efficiency.

SUMMARY OF THE INVENTION

In such circumstances, the present invention is intended to provide a liquid ejection head that enables easy and efficient connection for liquid and electrical connection and can prevent a liquid scattered from a connection part for liquid from adhering to an electrical connector, a liquid ejection apparatus, and a method of attaching a liquid ejection head.

A page-wide liquid ejection head of the present invention, configured to be removably installed in a main body of a liquid ejection apparatus includes a connection part for liquid through which a liquid is supplied from the main body and an electrical connector through which an electric signal is supplied from the main body, and the connection part for liquid and the electrical connector are located at one side of the liquid ejection head and are provided to face different directions from each other.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiments of the present invention will now be described with reference to drawings.

[Liquid Ejection Head]

Figure 1:
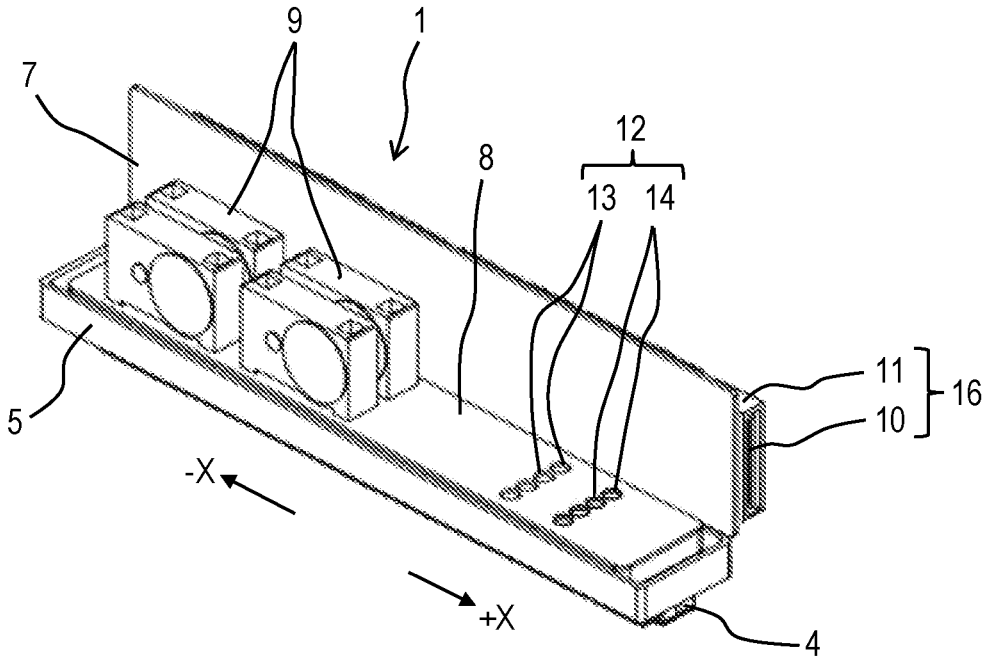
FIG. 1 is a perspective view of a liquid ejection head in an embodiment of the present invention, viewed from the top side.
Figure 2:
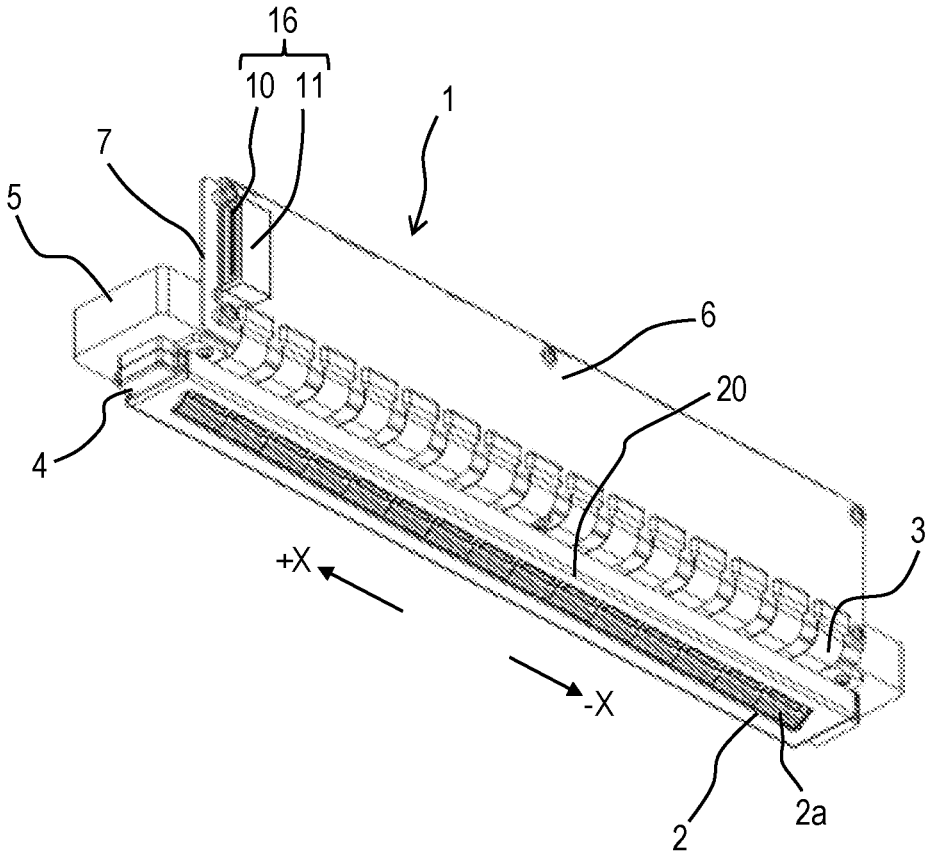
FIG. 2 is a perspective view of the liquid ejection head shown in FIG. 1, viewed from the bottom side.

FIG. 1 is a perspective view of a long-length liquid ejection head 1 in a first embodiment of the present invention, viewed from the top side. FIG. 2 is a perspective view of the liquid ejection head 1 viewed from the bottom side. The liquid ejection head 1 of the embodiment is an ink jet recording head, and the liquid ejection apparatus of the embodiment is an ink jet recording apparatus. The liquid ejection head is a page-wide liquid ejection head used in a page-wide liquid ejection apparatus and has, in the longitudinal direction, a dimension not less than the dimension of a liquid ejection object (for example, the recording medium 104 shown in FIG. 5) (a width not less than the width of an object).

The liquid ejection head 1 shown in FIGS. 1 and 2 includes a long plate-shaped support member (first support member) 5 having a bottom face to which a long plate-shaped base member (second support member) 4 is attached. To one side face (back face) of the support member 5, a protective plate 7 is attached. To the protective plate 7, a circuit board 6 is stacked and fixed. On the bottom face of the base member 4, a plurality of (15 pieces in an example) elemental substrates 2 are installed and arranged in a row at predetermined intervals. In the base member 4, distribution flow channels 17 are provided for distributing a plurality of types of liquids (for example, four color liquid inks) supplied from the liquid supply unit 8 described later) to the elemental substrates 2 (see FIG. 3). Each elemental substrate 2 includes an ejection port 2*a* for ejecting a liquid such as a liquid ink for recording and an energy generation element (for example, a heat generation device or a piezoelectric device) 2*c* provided in a pressure chamber 2*b* that communicates with the ejection port 2*a* (see FIG. 3). Each elemental substrate 2 is connected to an end of an electric wiring board (FPC: flexible printed circuit board) 3 provided corresponding to each elemental substrate 2. The other end of each electric wiring board 3 is connected to the circuit board 6. In other words, the respective electric wiring boards 3 electrically connect the corresponding elemental substrates 2 to one circuit board 6.

On the circuit board 6, an electrical connector 16 for electrical connection to the main body of a liquid ejection apparatus (also simply called "apparatus main body") is provided, and the electrical connector 16 includes an electrical connector portion 10 and an electrical connector portion cover 11. The electrical connector portion 10 is provided at one side of the circuit board 6 in the longitudinal direction (X-direction) of the liquid ejection head 1. The liquid ejection head 1 is to be attached to or detached from an apparatus main body by movement along the longitudinal direction, and the electrical connector portion 10 is provided around the leading end in the attachment process of the liquid ejection head 1. The electrical connector portion 10 is surrounded by the connector portion cover 11 having an opening that faces forward (+X-direction) in a head attachment process.

As shown in FIG. 1, the top face of the support member 5 supports a liquid supply unit 8. The liquid supply unit 8 includes four sub tanks 9 as negative pressure generation means, eight liquid joints 13, 14 included in a connection part for liquid 12, filters 19 (see FIG. 3), and inner flow channels 18 (see FIG. 3). The inner flow channels 18 are located between the corresponding liquid joints 13, 14 and the base member 4. The liquid joints 13, 14 shown in FIGS. 1 and 2 are provided on the top face of the supply unit 8 and include joints that open upward (Z-direction) of the liquid ejection head 1.

Figure 3:
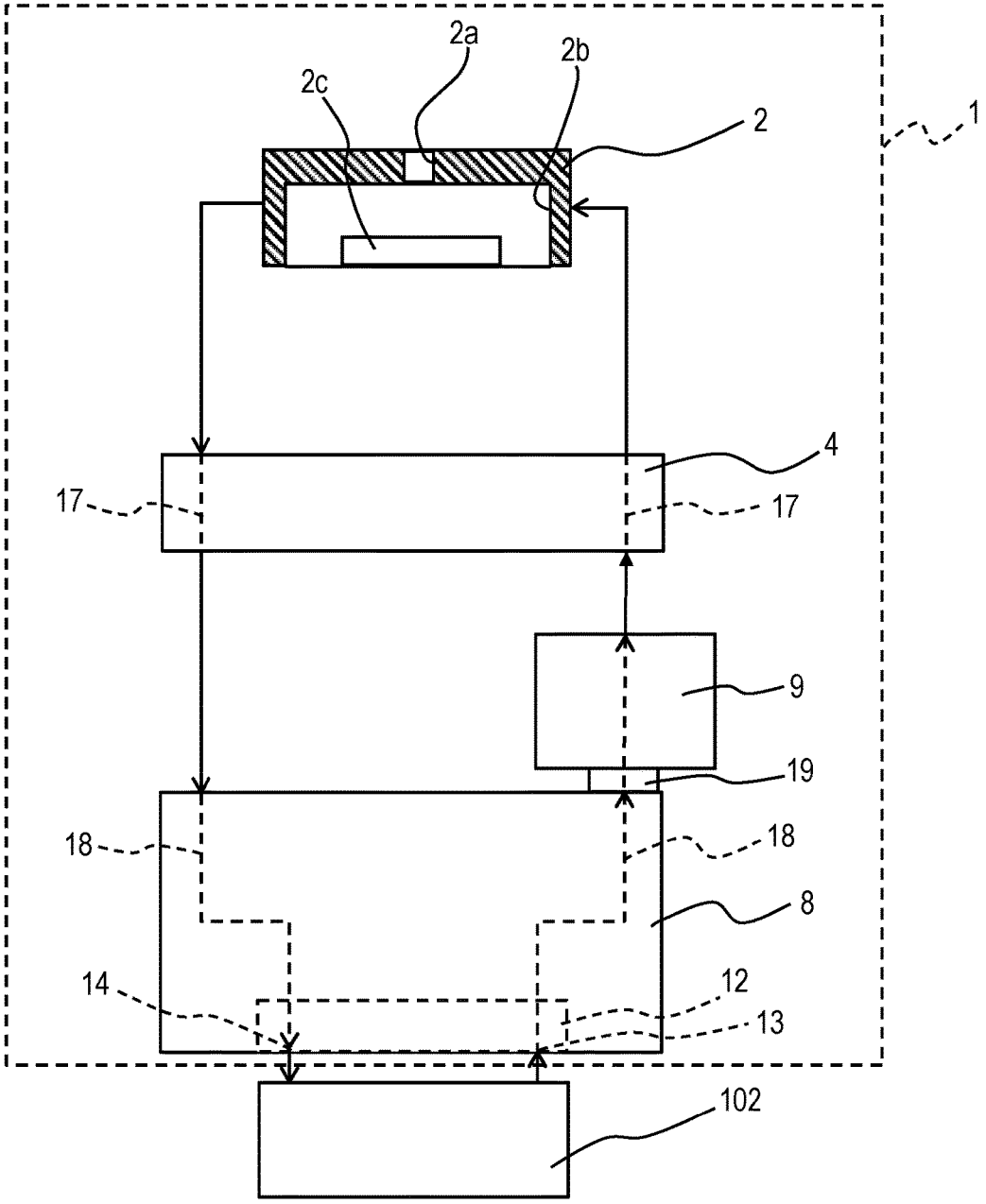
FIG. 3 is a block diagram showing a liquid circulation pathway including the liquid ejection head shown in FIG. 1.

FIG. 3 shows a circulation pathway included in the liquid ejection head 1 and a main body connection part for liquid 102 provided on an apparatus main body and connected to the liquid ejection head 1. As shown in FIG. 3, the liquid ejection head 1 includes liquid circulation pathways schematically shown in FIG. 3. In other words, a circulation inlet side liquid joint 13 of the connection part for liquid 12 connected to a liquid supply system (main body connection part for liquid 102) of the apparatus main body (described later) is connected to a supply side inner flow channel 18 in the liquid supply unit 8. The supply side inner flow channel 18 is connected through a filter 19 to a sub tank 9. The sub tank 9 is connected to a supply side distribution flow channel 17 in the base member 4, and the supply side distribution flow channel 17 is connected to the pressure chamber 2*b* in an elemental substrate 2. The pressure chamber 2*b* in the elemental substrate 2 communicates with the ejection port 2*a* and is connected to a recovery side distribution flow channel 17 in the base member 4. The recovery side distribution flow channel 17 is connected through a recovery side inner flow channel 18 in the supply unit 8 to a circulation outlet side liquid joint 14 of the connection part for liquid 12. The circulation outlet side liquid joint 14 is connected to the main body connection part for liquid 102 of the apparatus main body. As described above, the liquid circulation pathway of the liquid ejection head 1 is formed.

[Head Junction]

Figure 4:
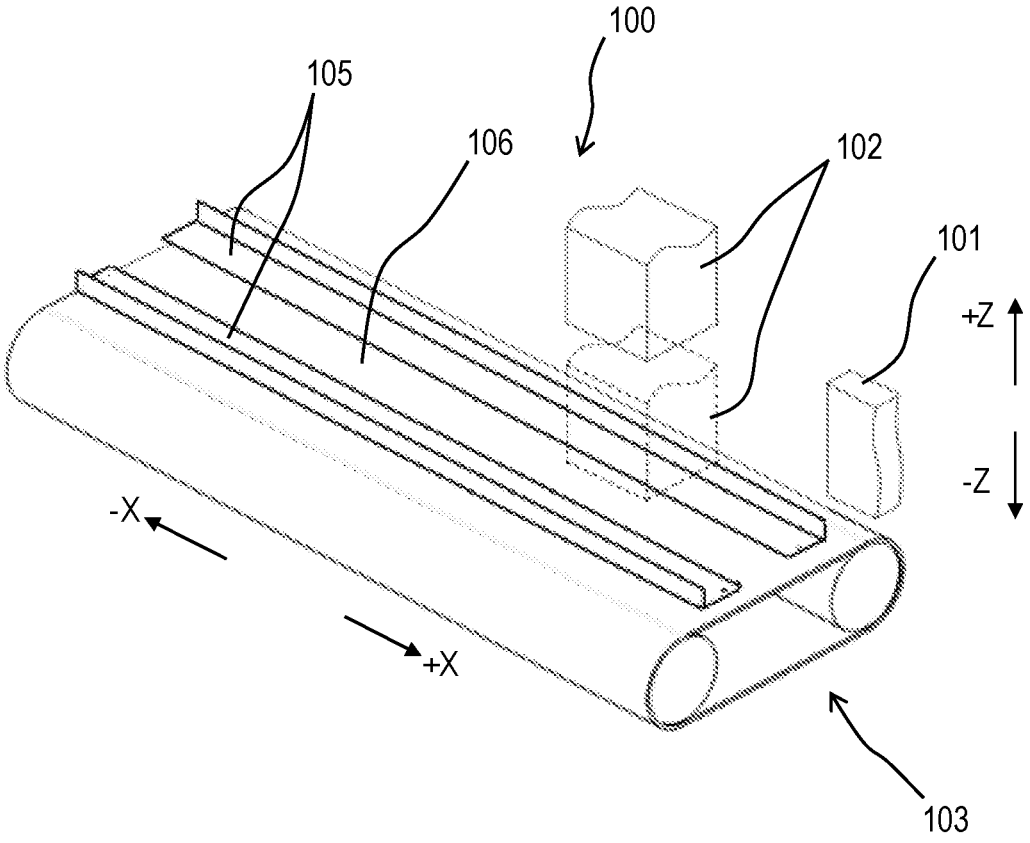
FIG. 4 is a perspective view showing a head junction to which the liquid ejection head shown in FIG. 1 is to be attached.
Figure 6:
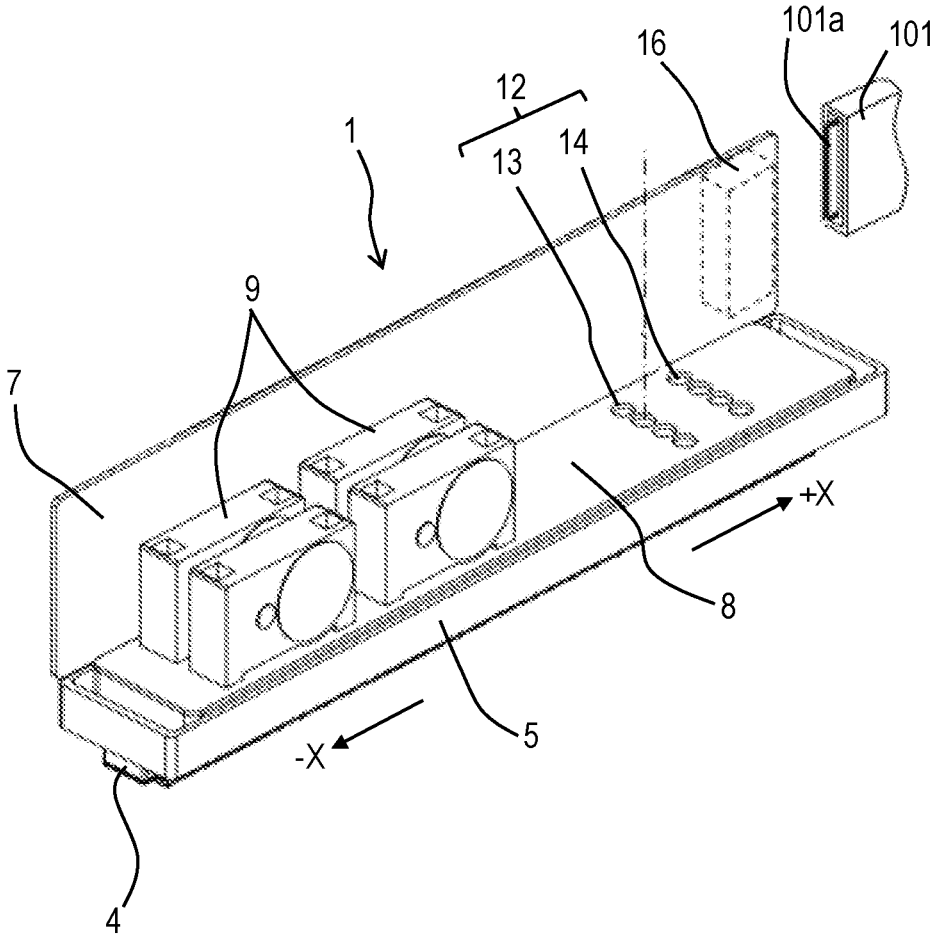
FIG. 6 is a perspective view for describing electrical connection of the liquid ejection head shown in FIG. 1.

FIG. 4 is a perspective view showing the structure of a head junction 100 of an apparatus main body in which the liquid ejection head 1 shown in FIGS. 1 and 2 is installed detachably (removably). The apparatus main body includes a conveyance mechanism 103 including rollers for conveying a recording medium (see FIG. 6) 104 such as recording papers. Above a recording medium conveyance face 106 of the conveyance mechanism 103, a pair of head guide rails 105 arranged a certain distance apart are provided. The head guide rails 105 are slidably fitted to concave rail grooves 20 provided on the base member 4 of the liquid ejection head 1 shown in FIG. 2. Above the recording medium conveyance face 106, a main body electrical connector 101 fixed to a casing (not shown in the drawings) and a main body connection part for liquid 102 movable up and down are provided.

[Attachment Process of Liquid Ejection Head]

The process of attaching the liquid ejection head 1 shown in FIGS. 1 and 2 to the head junction 100 of the apparatus main body shown in FIG. 4 will be described. In the present embodiment, the liquid ejection head 1 is moved along the longitudinal direction and thus is attached to the head junction 100 of the apparatus main body. In the attachment, while the head guide rails 105 are fitted to the rail grooves 20 of the base member 4, the liquid ejection head 1 is moved from the connection part for liquid 12 and the electrical connector 16 as the leading end side (in +X-direction). When fitted to the rail grooves 20 of the base member 4 of the liquid ejection head 1, the head guide rails 105 guide the liquid ejection head 1 and define the positional relation between the recording medium conveyance face 106 and the liquid ejection head 1.

Figure 5:
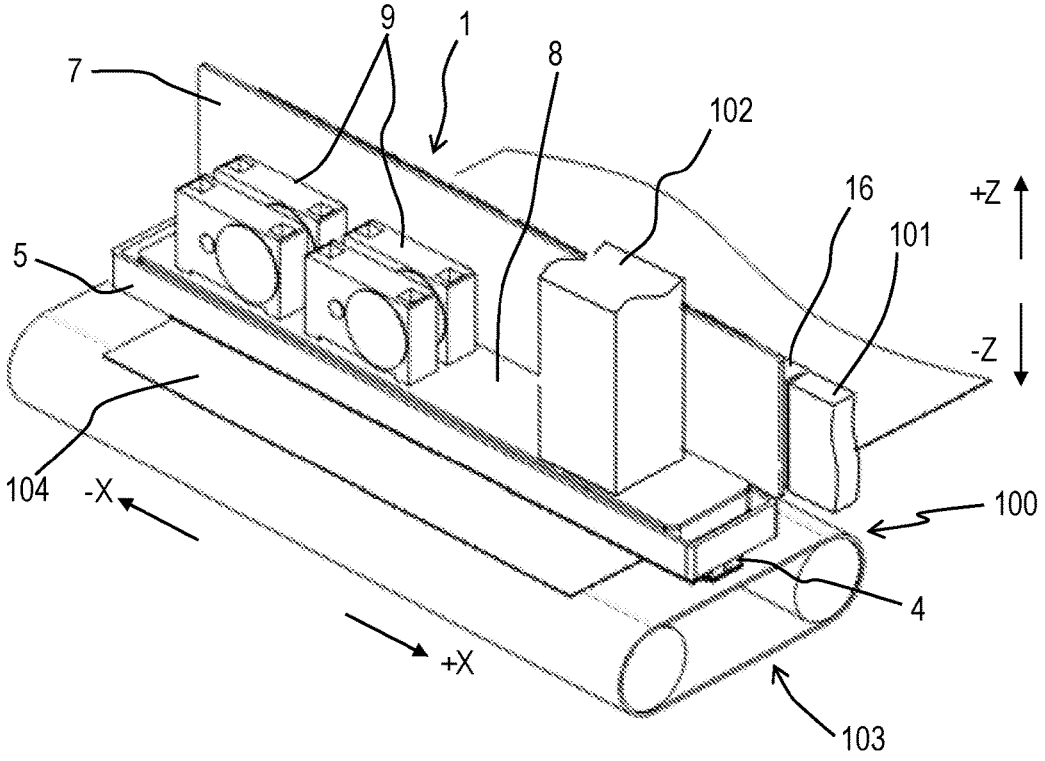
FIG. 5 is a perspective view showing the state in which the liquid ejection head shown in FIG. 1 is attached to the head junction.

FIG. 5 shows the state in which the liquid ejection head 1 is attached to the head junction 100 and can eject a liquid. While the elemental substrates 2 face downward (−Z-direction), the liquid ejection head 1 is inserted from an opening of the casing of an apparatus main body not shown in the drawing), along the head guide rails 105 (see FIG. 4, not shown in FIG. 5), then is moved in the longitudinal direction (+X-direction), and is fixed to a predetermined position. In association with the attachment process of the liquid ejection head 1 to the apparatus main body, the connection part for liquid 12 is connected, and the electrical connector 16 is connected. When the liquid ejection head 1 is inserted to a predetermined position of the apparatus main body, the liquid joints 13, 14 of the connection part for liquid 12 reach such a position as to face a main body connection part for liquid 102. At the same time, the electrical connector 16 of the liquid ejection head 1 comes into contact with a main body electrical connector 101. When the connector portion cover 11 of the electrical connector 16 comes into contact with the main body electrical connector 101, a slightly protruding terminal 101*a* of the main body electrical connector 101 shown in FIG. 6 enters the connector portion cover 11 and comes into contact with the electrical connector portion 10, and electrical connection is completed. This connection is achieved by exposure of the electrical connector portion 10 from an opening of the connector portion cover 11, facing forward in the moving direction of the liquid ejection head 1 (+X-direction) and by protrusion of the terminal 101*a* of the main body electrical connector 101 in the opposite direction (−X-direction). In other words, the electrical connector 16 of the embodiment faces forward in the moving direction (+X-direction) of the liquid ejection head 1, and the connection direction thereof is +X-direction.

Meanwhile, while the liquid joints 13, 14 of the connection part for liquid 12 face the main body connection part for liquid 102, the main body connection part for liquid 102 is moved downward (−Z-direction) to come into close contact with the connection part for liquid 12. At the time, leading ends (not shown) of liquid supply tubes of the main body connection part for liquid 102 are inserted in and connected to the liquid joints 13, 14. The liquid joints of the connection part for liquid 12 face upward (+Z-direction), and the connection direction thereof is +Z-direction.

As described above, when the liquid ejection head 1 is attached to the head junction 100 of the apparatus main body as shown in FIG. 5, the electrical connector 16 and the main body electrical connector 101 are electrically connected. Accordingly, the electric power or the electric signals from the apparatus main body are transmitted through the main body electrical connector 101 to the electrical connector 16 and further transmitted through the circuit board 6 and the electric wiring boards 3 to the energy generation elements 2*c* of the elemental substrates 2. When electric power or an electric signal is supplied to an energy generation element 2*c*, energy such as heat or pressure is generated, and the liquid in the pressure chamber 2*b* is ejected from the ejection port 2*a* toward the outside (for example, a recording medium 104).

When the connection part for liquid 12 and the main body connection part for liquid 102 are connected, the above-mentioned liquid circulation pathway is formed. In other words, a liquid is supplied from the main body connection part for liquid 102 to a circulation inlet side liquid joint 13 of the connection part for liquid 12, and by the negative pressure generation function of a sub tank 9, the liquid is sent through an inner flow channel 18 in the liquid supply unit 8 and a filter 19 to the sub tank 9. The liquid is further supplied from the sub tank 9 through a distribution flow channel 17 in the base member 4 to the pressure chamber 2*b* in an elemental substrate 2. By such a function of the energy generation element 2*c* as described above, the liquid in the pressure chamber 2*b* is ejected from the ejection port 2*a* to the outside. Of the liquid in the pressure chamber 2*b* in the elemental substrate 2, a liquid not ejected from the ejection port 2*a* to the outside and not purged at the time of maintenance is sent to a recovery side distribution flow channel 17 in the base member 4. The liquid is further sent through a recovery side inner flow channel 18 in the supply unit 8 to a circulation outlet side liquid joint 14 of the connection part for liquid 12. The liquid is then sent to the main body connection part for liquid 102 connected to the liquid joint 14. Hence, the liquid circulation pathway over the main body connection part for liquid 102 of the apparatus main body and the liquid ejection head 1 is formed, and satisfactory liquid ejection enables recording or the like.

In the present embodiment, in order to eject four types of liquids (four color liquid inks), channels 17, 18 or pressure chambers 2*b* are formed for the respective colors, in the elemental substrate 2, the base member 4, or the liquid supply unit 8. Accordingly, four sub tanks 9, four circulation inlet side liquid joints 13, and four circulation outlet side liquid joints 14 are provided. In other words, four flow channels are formed each from a circulation inlet side liquid joint 13 of the connection part for liquid 12 through the liquid supply unit 8 and the base member 4 to an elemental substrate 2 and through the base member 4 and the supply unit 8 to a circulation outlet side liquid joint 14.

As described above, the liquid ejection head 1 is a unit exchangeable with respect to the head junction 100 and is attached to or detached from the head junction 100 by movement in the longitudinal direction. In other words, an operator pushes the liquid ejection head 1 along the head guide rails 105 in the longitudinal direction as the head attachment direction (+X-direction) to a predetermined position in the casing of the apparatus main body and fixes the liquid ejection head to the apparatus main body, thereby completing the installation process. The predetermined position is such a position that the electrical connector 16 of the liquid ejection head 1 can come into contact with and be connected to the main body electrical connector of the head junction 100 and the connection part for liquid 12 of the liquid ejection head 1 can face and be connected to the main body connection part for liquid of the head junction 100. By pulling the liquid ejection head 1 attached to the head junction 100 in the longitudinal direction to the head detachment direction (−X-direction) that is opposite to the head attachment direction (+X-direction), the liquid ejection head can be removed from the apparatus main body to the outside.

The electrical connector 16 of the liquid ejection head 1 of the embodiment is provided at such a position as to face the main body electrical connector 101, and by the attachment process of the liquid ejection head 1, electrical connection can be completed. In other words, by pushing the liquid ejection head 1 to the apparatus main body in the head attachment direction (+X-direction), the electrical connector 16 and the main body electrical connector 101 are connected. When the apparatus main body detects the correct connection of the electrical connector 16, the main body connection part for liquid 102 is lowered to the liquid ejection head 1 in −Z-direction, and the connection part for liquid 12 and the main body connection part for liquid 102 are connected. The lowering and connection of the main body connection part for liquid 102 may be performed automatically by the apparatus main body or performed manually by an operator. After the electrical connection and the connection for liquid are completed as described above, a necessary purge process is performed to complete the preparation of the liquid ejection by the liquid ejection head 1.

In the present embodiment, both the electrical connector 16 and the connection part for liquid 12 are provided adjacent to each other at one side of the liquid ejection head 1 in the longitudinal direction. This structure can increase the reliability of the electrical connection and the connection for liquid.

When a liquid ejection head 1 in which an electrical connector 16 and a connection part for liquid 12 are largely spaced, for example, located at different sides of the liquid ejection head 1 in the longitudinal direction, is placed at an angle to a preferred attachment posture, the connection may be difficult. In particular, in the case of a long-length liquid ejection head 1 in which an electrical connector 16 and a connection part for liquid 12 are largely spaced, even when the attachment posture is slightly inclined, the connection parts 12, 16 are largely displaced from the corresponding preferred positions in the Y-direction, for example. Accordingly, even when the displacement of one connection part of the electrical connector 16 and the connection part for liquid 12 is intended to be corrected to be closer to a preferred position, the other connection part is still largely displaced, and the distance from a preferred position may be still large. In other words, even when the position of the liquid ejection head 1 is adjusted so that one connection part of the electrical connector 16 and the connection part for liquid 12 can be connected to one main body connection part, the other connection part may fail to be satisfactory connected to the other main body connection part. For example, even when the electrical connector 16 can be connected, the connection part for liquid 12 may be insufficiently connected to cause defects including liquid leakage. Hence, the positioning for enabling the connection of one connection part and the positioning for enabling the connection of the other connection part are required to be performed separately.

In contrast, in the present embodiment, both the electrical connector 16 and the connection part for liquid 12 are located at the same side of the liquid ejection head 1 in the longitudinal direction and are located adjacent to each other. In such a case, even when the liquid ejection head 1 is placed at an angle from a preferred attachment posture, both the connection parts 12, 16 are slightly displaced from preferred positions. Hence, when the position of one connection part of the electrical connector 16 and the connection part for liquid 12 is adjusted to be closer to a preferred position, the other connection part also comes closer to a preferred position. In other words, when the position of the liquid ejection head 1 is adjusted so that one connection part can be connected to a corresponding main body connection part, the other connection part is highly likely to come to such a position as to be connected to the other main body connection part. In the structure, to attach the liquid ejection head 1 to the head junction 100, the liquid ejection head 1 is inserted from the side with the electrical connector 16 into the casing of the apparatus main body. Hence, an operator is unlikely to accidentally touch the electrical connector portion 10 of the electrical connector 16 or the liquid joints 13, 14 of the connection part for liquid 12 adjacent thereto.

As described above, in the liquid ejection head 1 of the present embodiment, the electrical connector 16 and the connection part for liquid 12 are adjacently located at the same side of the liquid ejection head 1 in the longitudinal direction, and thus the liquid ejection head has an advantageous effect of enabling easy and satisfactory electrical connection and connection for liquid. In addition, the liquid ejection head in the present embodiment has an advantageous effect of preventing a liquid scattered from the connection part for liquid 12 from adhering to the electrical connector 16. The advantageous effects will next be described.

Figure 7A:
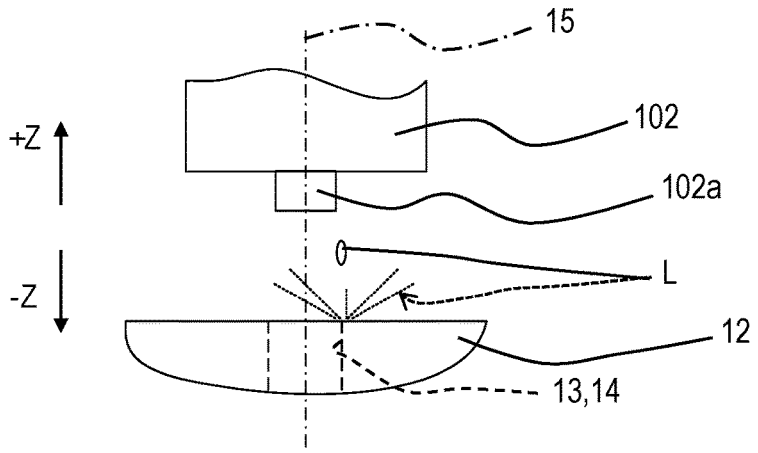
FIGS. 7A, 7B and 7C are front views for describing liquid scattering around a connection part for liquid.
Figure 7B:
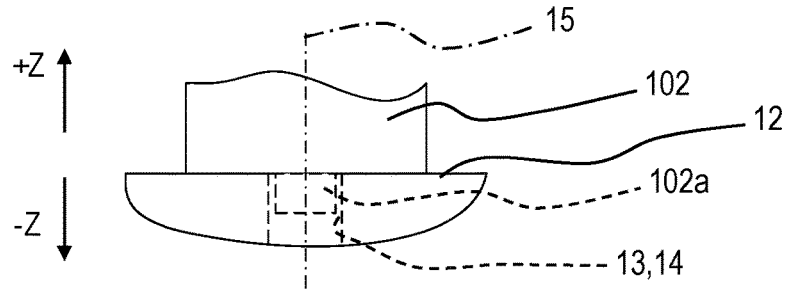
Figure 7C:
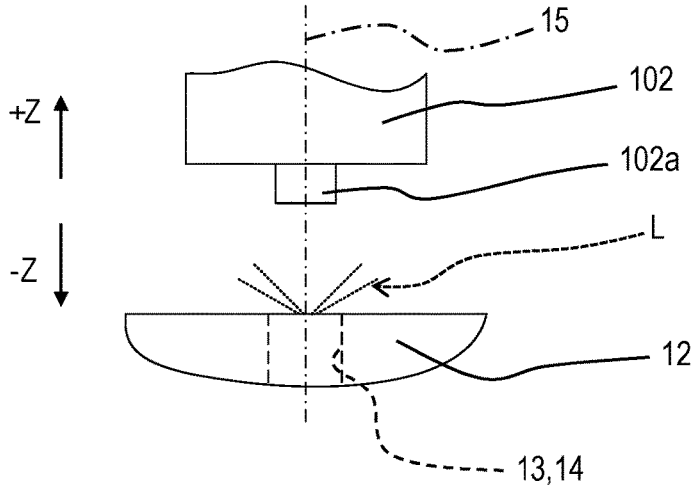

When an electrical connector 16 and a connection part for liquid 12 are adjacently located at the same side of a liquid ejection head 1 in the longitudinal direction for easy and satisfactory electrical connection and connection for liquid, care must be taken that a liquid does not adhere to the electrical connector 16. The liquid that can adhere to the electrical connector 16 is typically a liquid scattered around liquid joints 13, 14 of the connection part for liquid 12 of the liquid ejection head 1 that is connected to the main body connection part for liquid 102 of an apparatus main body. In order to ensure the passage of a liquid, the connection part for liquid 12 of the liquid ejection head 1 is fitted to the main body connection part for liquid 102 of the apparatus main body. For example, as shown in FIG. 7A, a liquid joint 13, 14 of the connection part for liquid 12 has an opening end, and the main body connection part for liquid 102 of the apparatus main body has a joint seal 102*a* as a protruded hollow tube. As shown in FIG. 7B, the joint seal 102*a* is inserted into the liquid joint 13, 14. In the liquid joint 13, 14, a joint tube (not shown in the drawings) may be provided, and the joint tube may be inserted into the joint seal 102*a*. In such a structure, the sealing function of the joint seal 102*a* mainly prevents air or liquid leakage from the connection part. In order to achieve such sealing function, a larger insertion force than the rubber reaction force of the joint seal 102*a* is required to insert the joint tube. When the joint tube is removed, the rubber reaction force of the joint seal 102*a* may cause a liquid L in contact with the joint seal 102*a* to be scattered to the periphery as shown in FIG. 7C. A liquid L in contact with and adhering to the joint seal 102*a* at the time of connection shown in FIG. 7B may drop after removal of the joint seal 102*a* from the liquid joint 13, 14 by any vibration, impact, or the like as shown in FIG. 7A.

Scattering of a liquid L by dropping from the joint seal 102*a* shown in FIG. 7A or scattering of a liquid L when the joint seal 102*a* is removed shown in FIG. 7C is caused around the pathway formed by connection of the joint seal 102*a* and the liquid joint 13, 14. In other words, the scattered liquid L spreads in a region having the center as a virtual joint axis 15 indicated by the dashed lines in FIGS. 7A to 7C. Hence, the electrical connector 16 to which a liquid L is intended not to adhere for prevention of electrical short-circuit or corrosion is preferably provided at a position out of the liquid L scattering region having the center as the virtual joint axis 15. However, as described above, when a connection part for liquid 12 and an electrical connector 16 are spaced apart from each other, satisfactory connection between both the connection parts 12, 16 may not be easily achieved due to inclination of the attachment posture of the liquid ejection head 1 or other effects. Hence, the electrical connector 16 is preferably provided relatively close to the connection part for liquid 12 and is preferably located out of the scattering region of the liquid L.

As a result of such consideration, in the present invention, the electrical connector 16 and the connection part for liquid 12 are provided at the same side (one side) of the liquid ejection head 1 in the longitudinal direction and are provided on different faces of the liquid ejection head. In other words, in the example shown in FIGS. 1, 2, 5, and 6, the electrical connector 16 is provided on the back face of the circuit board 6, and the connection part for liquid 12 is provided on the top face of the supply unit 8. The electrical connector 16 and the connection part for liquid 12 are provided on different faces of the liquid ejection head 1. When the focus is on this point, the electrical connector 16 is not located on the same plane of the connection part for liquid 12, and the electrical connector 16 is not located on the face on which a liquid L is scattered as shown in FIGS. 7A and 7C. Hence, a scattered liquid L is highly unlikely to adhere to the electrical connector 16.

In the structure shown in FIGS. 1, 2, 5, and 6, the electrical connector 16 faces forward in the moving direction when the ejection head 1 is installed, or faces the head attachment direction (+X-direction). Meanwhile, the connection part for liquid 12 faces upward (+Z-direction). In other words, the electrical connector 16 and the connection part for liquid 12 face different directions from each other. As shown in FIGS. 7A and 7C, a liquid scattered from the connection part for liquid 12 that faces +Z-direction is unlikely to enter the electrical connector 16 (electrical connector portion 10) that faces +X-direction orthogonal to +Z-direction. Hence, a scattered liquid is highly unlikely to adhere to the electrical connector. In the embodiment, the direction of the electrical connector 16 is orthogonal to the direction of the connection part for liquid 12, and thus a liquid scattered from the connection part for liquid 12 is unlikely to enter the electrical connector 16. The direction of an electrical connector 16 as used herein is the direction in which the electrical connector portion 10 as the main component of the electrical connection is not covered with the connector portion cover 11 but is exposed, and is the direction allowing the terminal 101*a* of the main body electrical connector 101 to approach and to come into contact with the electrical connector portion 10. When a terminal 101*a* is located in front of the liquid ejection head 1 and the liquid ejection head 1 is moved in +X-direction, the terminal 101*a* can enter the connector portion cover 11 and come into contact with the electrical connector portion 10. Hence, the electrical connector 16 faces +X-direction, which can also be called the connection direction of the electrical connector 16.

The direction of a connection part for liquid 12 is the direction in which the openings of the liquid joints 13, 14 are exposed, and is the direction allowing joint seals 102*a* of the main body connection part for liquid 102 to approach and to be inserted in or fitted to the liquid joints 13, 14. When joint seals 102*a* are located above the liquid ejection head 1 and the liquid ejection head 1 is relatively moved in +Z-direction, the joint seals 102*a* can enter or be fitted to the liquid joints 13, 14. Hence, the connection part for liquid 12 faces +Z-direction, which can also be called the connection direction of the connection part for liquid 12.

In the present embodiment, the connection direction of the electrical connector 16 to the main body electrical connector 101 is the longitudinal direction of the liquid ejection head 1, whereas the connection direction of the connection part for liquid 12 to the main body connection part for liquid 102 is the vertical direction (through-thickness direction of the liquid ejection head 1). Accordingly, the connection direction of the electrical connector 16 differs from the connection direction of the connection part for liquid 12, and the connection directions intersect with each other and are preferably orthogonal to each other. A liquid L scattered from the connection part for liquid 12, the connection direction of which to the main body connection part for liquid 102 is the through-thickness direction of the liquid ejection head 1, is unlikely to enter the inside (electrical connector portion) of the electrical connector 16, the connection direction of which to the main body electrical connector 101 is the longitudinal direction of the liquid ejection head 1. Accordingly, a scattered liquid L is highly unlikely to adhere to the electrical connector. In the present embodiment, the connection direction of the electrical connector 16 is orthogonal to the connection direction of the connection part for liquid 12, and thus a liquid L scattered from the connection part for liquid 12 is particularly unlikely to enter the electrical connector 16.

As described above, the present invention can prevent a liquid L scattered from the connection part for liquid 12 from adhering to the electrical connector 16 and can suppress electrical short-circuit or corrosion by the liquid L. This is achieved by satisfying at least one of the structure in which the electrical connector 16 and the connection part for liquid 12 are located on different faces and the structure in which the connection parts face different directions from each other (the respective connection directions differ). More specifically, in the liquid ejection head 1 of the embodiment, the electrical connector portion 10 of the electrical connector 16 (see FIG. 1) is not exposed toward the joint axis 15 (see FIGS. 7A to 7C). Concurrently with the attachment of the liquid ejection head 1 to the head junction 100, the electrical connection of the electrical connector 16 to the main body electrical connector 101 is completed, and the electrical connector portion 10 is covered with other members (the connector portion cover 11 and a cover of the main body electrical connector). Hence, a liquid dropping and scattered from a joint seal 102*a* of the main body connection part for liquid 102 is unlikely to adhere to the electrical connector portion 10. In addition, the joint seals 102*a* and the connection part for liquid 12 are disconnected while the electrical connector portion 10 is still connected to the terminal 101*a* and is covered with other members, and thus the liquid scattered at the time of the disconnection is also unlikely to adhere to the electrical connector portion 10.

In the present embodiment, covering of the electrical connector portion 10 of the electrical connector 16 with the connector portion cover 11 from five directions (all directions except the head attachment direction (+X-direction)) contributes to the suppression of liquid adhesion to the electrical connector portion 10. The electrical connector 16 is provided outside (terminal side) of the connection part for liquid 12 in the longitudinal direction of the liquid ejection head 1, thus the electrical connector 16 is located away from the joint axis 15 around which a liquid L may be scattered, and a scattered liquid L is unlikely to reach the electrical connector 16. In addition, the electrical connector 16 is located higher than the liquid joints 13, 14, and thus even when a liquid L is scattered around the liquid joints 13, 14 by attachment/detachment of the joint seals 102*a*, the liquid is unlikely to reach the electrical connector 16 located at a higher position.

In the present embodiment, the protective plate 7 is provided between the connection part for liquid 12 and the electrical connector 16 and the circuit board 6, and thus a liquid L overflowing or scattered around the connection part for liquid 12 is more unlikely to adhere to the circuit board 6 or the electrical connector 16.

The present embodiment has a beneficial effect particularly on a liquid ejection head 1 including no liquid absorber or what is called a raw-ink liquid ejection head. The raw-ink liquid ejection head 1 does not include a liquid absorber for holding a liquid therein by negative pressure, and thus a liquid L is likely to overflow or to be scattered from a connection part for liquid 12. Hence, the application of the present embodiment is extremely effective to suppress the adhesion of a liquid L to an electrical connector 16.

The present embodiment has a beneficial effect particularly on a liquid ejection head 1 in which a liquid circulation pathway is formed. In the structure having a circulation pathway as shown in FIG. 1, two liquid joints 13, 14 at a circulation inlet side and a circulation outlet side are required for each type of liquid (each color ink), and the number of positions capable of causing liquid scattering is larger than that of a structure without any circulation pathway. Hence, it is extremely effective to apply the present embodiment that can suppress the adhesion of a liquid L to an electrical connector 16, to the structure having circulation pathways.

As described above, the liquid ejection head 1 of the present embodiment has circulation pathways, and each circulation inlet side liquid joint 13 communicating with the sub tank 9 through a relatively short channel is provided at an inner position of the corresponding circulation outlet side liquid joint 14 or close to the center in the longitudinal direction of the liquid ejection head 1. This arrangement is made by considering that the liquid storage volume of the sub tank 9 is larger than those of the other portions in the circulation pathway and a liquid capable of causing liquid leakage or scattering is likely to be stored therein. In other words, a liquid is likely to be scattered around the joint axis 15 of the circulation inlet side liquid joint 13 located close to the sub tank 9 in which a relatively large amount of a liquid is stored. Hence, the circulation inlet side liquid joints 13 are provided away from the electrical connector 16 that is located close to the end in the longitudinal direction, and thus a liquid L is unlikely to adhere to the electrical connector 16.

In addition, both the circulation inlet side liquid joints 13 and the circulation outlet side liquid joints 14 have openings that face upward of the liquid ejection head 1. With the structure, a liquid left in the circulation inlet side and circulation outlet side liquid joints 13, 14 immediately after lifting of the main body connection part for liquid 102 stays in the liquid supply unit 8 but is not leaked to the outside.

In the structure of the present embodiment, the moving direction of the liquid ejection head 1 is the same as the connection direction of the electrical connector 16 at the time of attachment, and the connection for liquid is performed in a different direction therefrom. Hence, a liquid is unlikely to adhere to the electrical connector 16. When electrical connection is performed and then a connection part for liquid 12 is automatically connected to the main body connection part for liquid, an exchange operator cannot visually observe the liquid scattering state before and after the connection for liquid. With the above-mentioned structure, even when a liquid is scattered, the scattered liquid is prevented from adhering to the electrical connector 16 to suppress malfunction. Hence, application of electric current to the liquid ejection apparatus can be started without visual observation.

Figure 8A:
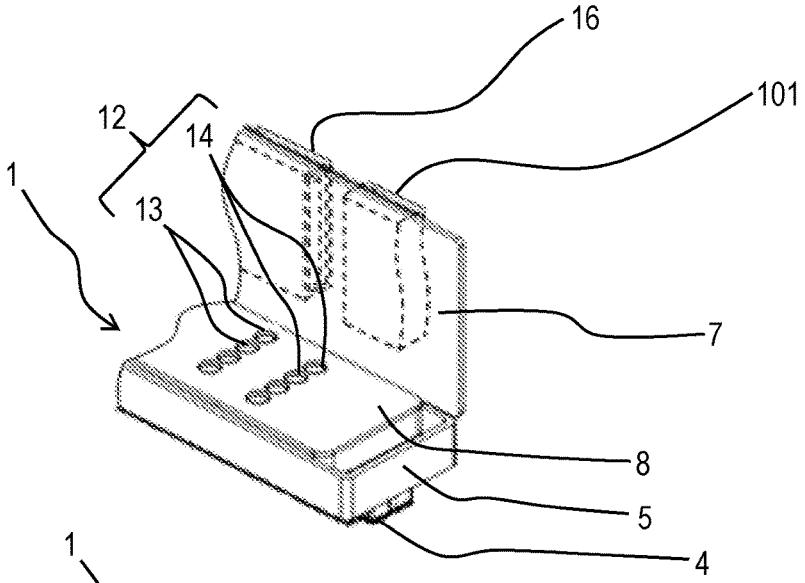
FIGS. 8A, 8B and 8C are perspective views of principal parts of liquid ejection heads in other embodiments of the present invention, viewed from the top side.
Figure 8B:
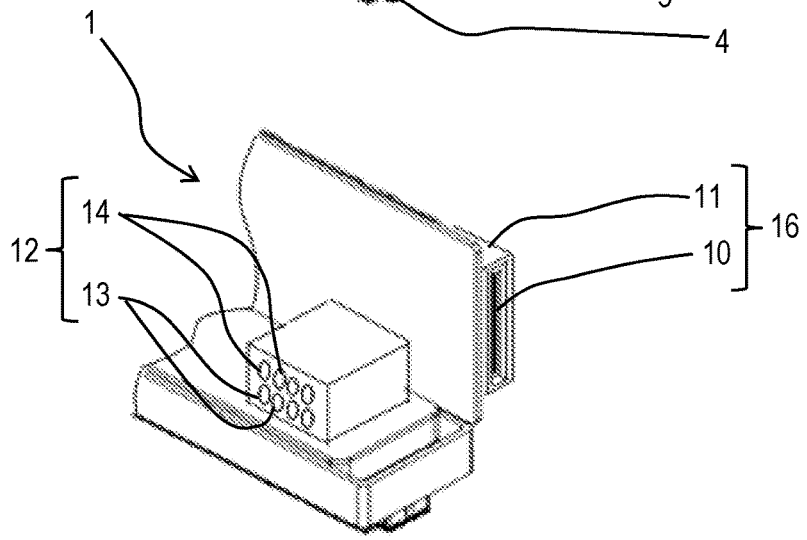
Figure 8C:
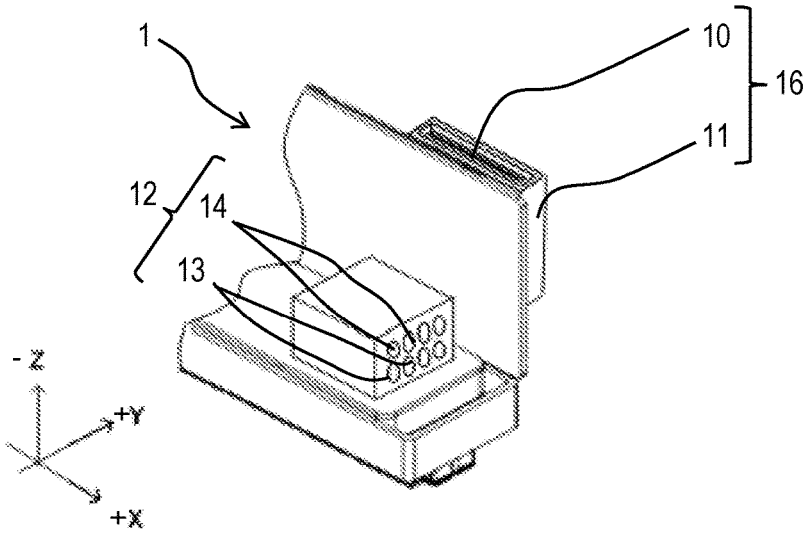

FIGS. 8A to 8C show other embodiments of the present invention. In each example shown in FIGS. 8A to 8C, when a liquid ejection head 1 is moved along the longitudinal direction and is attached to a head junction 100, one of an electrical connector 16 and a connection part for liquid 12 is connected to a main body connection part and sealed.

In the embodiment shown in FIG. 8A, as with the first embodiment, an electrical connector 16 is provided on the back face of a protective plate 7, and a connection part for liquid 12 is provided on the top face of a liquid supply unit 8. In the present embodiment, in the longitudinal direction of the liquid ejection head 1, the electrical connector 16 is located more closely to the center of the liquid ejection head 1 than the first embodiment, and the position of the electrical connector 16 is substantially the same as the position of the connection part for liquid 12. With the structure, the electrical connector 16 is adjacent to the connection part for liquid 12. Hence, even when the liquid ejection head 1 is held at a small angle to the head junction 100, the electrical connector 16 and the connection part for liquid 12 can be connected to a main body electrical connector 101 and a main body connection part for liquid 102 with high reliability. The main body electrical connector 101 is located more closely to the center in the longitudinal direction (−X-direction) than that in the example shown in FIG. 1 so that the electrical connector 16 can be connected to the main body electrical connector 101 also in the structure when the liquid ejection head 1 is placed at a predetermined position of the head junction 100. The electrical connector 16 may be provided more closely to the center in the longitudinal direction than the connection part for liquid 12.

In the embodiment shown in FIG. 8B, the positions of an electrical connector 16 and a connection part for liquid 12 are the same as in the first embodiment. However, the direction and the connection direction of the connection part for liquid 12 are the front side of the liquid ejection head (−Y-direction). Accordingly, a main body connection part for liquid 12 (not shown in the drawing) is located at the front side of a head junction and is horizontally movable. In the structure, the main body connection part for liquid 12 and the connection direction thereof are the opposite side to the side with the electrical connector 16 across the protective plate 7. Hence, a liquid scattered from the main body connection part for liquid 12 is unlikely to adhere to the electrical connector 16.

In the embodiment shown in FIG. 8C, the positions of an electrical connector 16 and a connection part for liquid 12 are the same as in the first embodiment. However, the direction and the connection direction of the electrical connector 16 are the top face side of the liquid ejection head (−Z-direction), and the direction and the connection direction of the connection part for liquid 12 are the head attachment direction (+X-direction). Hence, a main body connection part for liquid 102 (not shown in the drawing) is located at such a position as to face the connection part for liquid 12 and is provided to face the head detachment direction of the head junction 100. In addition, the electrical connector 16 is located on the back side of the head junction 100 and is vertically movable. The direction and the connection direction of the electrical connector 16 may be the bottom side of the liquid ejection head 1.

From the embodiments described above, an electrical connector 16 or a connection part for liquid 12 facing any direction can be appropriately selected depending on ease in arrangement of a main body electrical connector 101 and a main body connection part for liquid 102 of a head junction 100, moving directions, or the like. Although no more examples will be described, the positions and the directions (connection directions) of the electrical connector 16 and the connection part for liquid 12 can be optionally modified. However, in the present invention, the electrical connector 16 and the connection part for liquid 12 are provided at the same side of a liquid ejection head 1 in the longitudinal direction as described above. In the structure of the present invention, the electrical connector 16 and the connection part for liquid 12 are located on different faces or face different directions from each other (the respective connection directions differ).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-117978 filed Jun. 15, 2017, which is hereby incorporated by reference herein in its entirety.

What is claimed is:

1. A page-wide liquid ejection head configured to be removably installed in a main body of a liquid ejection apparatus, the liquid ejection head comprising:

a connection part for liquid through which a liquid is supplied from the main body;

a sub tank as a negative pressure generation means connected to the connection part for liquid; and an electrical connector through which an electric signal is supplied from the main body, wherein a circulation pathway is formed between the main body of the liquid ejection apparatus and the liquid ejection head and when the liquid ejection head is installed in the main body of the liquid ejection apparatus, and the connection part for liquid and the electrical connector are located at one side of the liquid ejection head with respect to a longitudinal direction and are provided to face different directions from each other.

2. The liquid ejection head according to claim 1, wherein a connection direction between the connection part for liquid and a main body connection part for liquid of the main body differs from a connection direction between the electrical connector and a main body electrical connector of the main body.

3. The liquid ejection head according to claim 1, wherein the electrical connector is provided at an outer position of the connection part for liquid with respect to the longitudinal direction of the liquid ejection head.

4. The liquid ejection head according to claim 1, wherein the electrical connector includes an electrical connector portion and a connector portion cover covering the electrical connector portion and having an opening, and the opening of the connector portion cover opens toward an outside of the liquid ejection head with respect to the longitudinal direction.

5. The liquid ejection head according to claim 1, further comprising an elemental substrate, the elemental substrate including an energy generation element configured to generate energy to eject a liquid and a pressure chamber including the energy generation element therein, wherein the energy generation element is connected to the electrical connector, and the pressure chamber is connected to the connection part for liquid.

6. The liquid ejection head according to claim 1, wherein the connection part for liquid includes a circulation inlet side liquid joint and a circulation outlet side liquid joint, and the circulation inlet side liquid joint is provided more closely to the sub tank than the circulation outlet side liquid joint and more distantly from the electrical connector than the circulation outlet side liquid joint.

7. A liquid ejection apparatus comprising:

the liquid ejection head according to claim 1; and a main body head junction, the liquid ejection head being detachably attached to the head junction, wherein while the liquid ejection head is attached to the head junction, one of the electrical connector and the connection part for liquid is connected to a main body connection part from the longitudinal direction of the liquid ejection head, and the other of the electrical connector and the connection part for liquid is connected to another main body connection part from a direction different from the longitudinal direction of the liquid ejection head.

8. The liquid ejection apparatus according to claim 7, wherein by movement of the liquid ejection head in the longitudinal direction, the liquid ejection head is attached to the head junction, and one of the electrical connector and the connection part for liquid is connected to the main body connection part.

9. The liquid ejection apparatus according to claim 8, wherein the other of the electrical connector and the connection part for liquid is connected to the other main body connection part by movement of the other main body connection part in a direction intersecting the longitudinal direction.

10. The liquid ejection apparatus according to claim 9, wherein the other main body connection part moves in a direction orthogonal to the longitudinal direction.

11. The liquid ejection apparatus according to claim 8, wherein while the liquid ejection head is attached to the head junction, the connection part for liquid is connected to the main body connection part or the other main body connection part to form the circulation pathway within the main body of the liquid ejection apparatus and the liquid ejection head.

12. A method of attaching a page-wide liquid ejection head to a main body of a liquid ejection apparatus, the method comprising:

moving the liquid ejection head in a longitudinal direction to attach the liquid ejection head to a main body head junction of the liquid ejection apparatus, connecting one of an electrical connector and a connection part for liquid of the liquid ejection head to a main body connection part;

moving another main body connection part in a direction intersecting the longitudinal direction to connect the other of the electrical connector and the connection part for liquid to the other main body connection part such that a sub tank as a negative pressure generation means is connected to the connection part for liquid; and forming a circulation pathway between the main body of the liquid ejection apparatus and the liquid ejection head.

13. The method of attaching a liquid ejection head according to claim 12, wherein when the other of the electrical connector and the connection part for liquid is connected to the other main body connection part, the other main body connection part is moved in a direction orthogonal to the longitudinal direction.

14. The method of attaching a liquid ejection head according to claim 12, wherein the connection part for liquid is connected to one connection part for liquid of the main body connection part and the other main body connection part to form the circulation pathway within the main body of the liquid ejection apparatus and the liquid ejection head.

* * * * *